US005593623A

United States Patent [19]

Mohss

[11] Patent Number: 5,593,623

[45] Date of Patent: Jan. 14, 1997

[54] CASTING MOULD

[76] Inventor: Anders Mohss, Västanåker 8460, Hudiksvall, Sweden, S-824 00

[21] Appl. No.: 411,803

[22] PCT Filed: Sep. 27, 1993

[86] PCT No.: PCT/SE93/00776

§ 371 Date: Apr. 10, 1995

§ 102(e) Date: Apr. 10, 1995

[87] PCT Pub. No.: WO94/09228

PCT Pub. Date: Apr. 28, 1994

[30] Foreign Application Priority Data

Oct. 9, 1992 [SE] Sweden ..... 9202965

[51] Int. Cl.[6] ..... E04G 13/02; E02D 5/34

[52] U.S. Cl. ..... 264/32; 249/48; 249/51; 264/313; 405/233; 405/243

[58] Field of Search ..... 249/48, 51, 117; 264/32, 313, 333; 405/222, 223, 233, 243, 257

[56] References Cited

U.S. PATENT DOCUMENTS

| | | | |
|---|---|---|---|
| 3,496,729 | 2/1970 | Pleuger | 405/257 |
| 3,726,950 | 4/1973 | Turzillo | 405/223 |
| 4,096,944 | 6/1978 | Simpson | 405/233 |

FOREIGN PATENT DOCUMENTS

| | | | |
|---|---|---|---|
| 0128504 | 5/1974 | Denmark . | |
| 3732894 | 3/1989 | Germany | 249/48 |
| 56-163319 | 12/1981 | Japan | 405/222 |
| 63-51518 | 3/1988 | Japan | 405/223 |
| 64-33315 | 2/1989 | Japan | 249/51 |
| 0205256 | 6/1966 | Sweden . | |
| 940687 | 10/1963 | United Kingdom | 405/222 |

OTHER PUBLICATIONS

Patent Abstracts of Japan, vol. 12, No. 64, M–672, abstract of JP, A, 62–211420 (ASAHI CHEM IND CO LTD), 17 Sep. 1987.

Patent Abstracts of Japan, vol. 13, No. 214, M–827, abstract of JP, A, 1–33315 (ASAHI CHEM IND CO LTD), 3 Feb. 1989.

*Primary Examiner*—James P. Mackey

*Attorney, Agent, or Firm*—Browdy and Neimark

[57] ABSTRACT

A casting mould for keeping the cast compound together and supporting it on casting elongated objects, standing on an underlayer and extending vertically comprises a flexible elongated envelope (3) being substantially inelastic and having an opening (7) at one end thereof for supplying cast compound (6). The envelope is arranged to be held substantially vertically while being stretched by cast compound introduced through said opening (7) so as to form a casting mould having a circular cross-section, extending vertically and supporting and keeping the cast compound together.

20 Claims, 1 Drawing Sheet

CASTING MOULD

FIELD OF THE INVENTION AND PRIOR ART

The present invention relates to a casting mould for keeping the cast compound together and supporting it on casting elongated objects standing on an underlayer and extending vertically.

Elongated objects extending vertically and having shapes, uses and cast compound material within very broad ranges of variations may be concerned. Although the particular case of casting columns for buildings, especially plinths for houses and the like, with concrete as cast compound and the particular problems arising thereby, will be described hereinafter, this is not at all to be interpreted as any limitation of the invention but only as an example for explanation thereof.

Rigid tubes, usually cardboard tubes, are used as casting moulds in casting different types of columns for building purposes, and in particular in casting plinths for houses, cottages and the like. These tubes are often provided in certain lengths, for instance 2.5 m, and they are therefor to be bought in these lengths and after that be cut into the length suitable for the casting in question, which results in a considerable waste of such cardboard tubes. Another disadvantage of the use of such tubes as casting moulds consists in that they are bulky and demand a considerable space—both in the building product shop or a similar sales location providing them and in the vehicles to be used to transport them to a place for their use.

BRIEF DESCRIPTION OF THE INVENTION

The object of the present invention is to provide a casting mould of the type defined in the introduction, which finds a remedy to the inconveniences mentioned above and associated with prior casting moulds for casting objects of the type in question.

This object is, in accordance with the present invention, obtained by providing a casting mould comprising a flexible elongated envelope which is substantially inelastic and having an opening at one end thereof for supplying cast compound, i.e. the casting material, e.g. concrete, said envelope being arranged to be held substantially vertically while being stretched by cast compound introduced through said opening so as to form a casting mould having a circular cross-section, extending vertically and supporting and keeping the cast compound together.

Thus, the invention is based on the understanding of the very surprising phenomenon, that a flexible elongated envelope being substantially inelastic and which may be stretched to assume a circular cross-section could keep the cast compound together and at the same time give the support required for assuming and maintaining a vertical extension during the hardening of the cast compound, even though the envelope does not have to have any kind of consistency alone. However, it has in practise turned out that the use of such an envelope as a casting mould functions excellently. Thus, the mutual co-operation between the cast compound and the casting mould consisting of the envelope takes place by using the gravitation of the cast compound for keeping the casting mould perpendicular, so that the latter assumes a shape and an extension for keeping the cast compound in a determined shape during the hardening or solidification thereof. Thus, thanks to the invention, it is possible to provide casting moulds demanding a neglectable space with respect to what previously was the case in storage and transport, since they may be stored flat so as to assume the casting mould shape thereof while being stretched at the occasion of the very casting. Elongated webs, which are preferably wound on rolls, from which casting moulds of exactly the lengths desired may be separated, may advantageously be provided, so that no waste is produced any longer. Accordingly, for instance a carpenter may in this way carry casting moulds of a very considerable total length along, for example 20 meters plinth moulds, and this length may be carefully adjusted to the requirements of casting moulds at the building location in question, but it would of course also be possible that he carries considerable lengths of casting mould in reserve, which would have been impossible before, but doesn't result in any notable further demands of space any longer. The casting moulds of the type according to the present invention may also be manufactured at a very low cost with respect to prior casting moulds for corresponding casting.

A thin plastic film has turned out to be an advantageous material for casting moulds according to the invention, but other materials such as for example, cloth or fabric would also be conceivable.

The invention also relates to a method for casting elongated objects extending vertically, which utilises a casting mould designed in accordance with the invention, as well as the very surprising use of a flexible elongated envelope being substantially inelastic and having an opening at one end thereof for supplying cast compound as casting mould according to the appended independent method and use claims, respectively.

Further advantages and preferred features of the invention will appear from the other dependent claims as well as the description following below.

BRIEF DESCRIPTION OF THE DRAWINGS

With reference to the appended drawings, below follows a description of a preferred embodiment of the invention cited as an example.

In the drawings.

DETAILED DESCRIPTION OF A PREFERRED EMBODIMENT OF THE INVENTION

Figure 1:
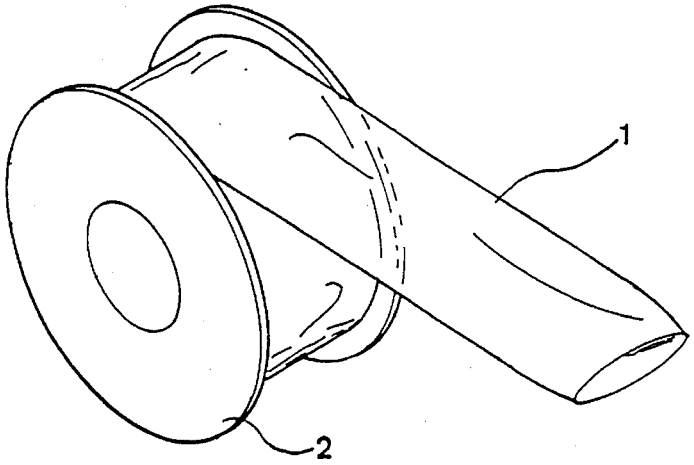
FIG. 1 is a perspective view illustrating how casting moulds according to a preferred embodiment of the invention may be stored and provided for use.

It is illustrated in FIG. 1 how casting moulds according to a preferred embodiment of the invention may be provided as a long material web 1, which is wound on a storage roll 2. The material web 1 is made of a plastic film or foil, which may have a thickness of for example some tenths of a millimetre. The thickness of the web 1 is sufficient to provide the web with enough strength to provide by itself the support required for assuming and maintaining the vertical extension as illustrated, i.e. without any exterior supporting wall. The web 1 has surrounding walls enclosing a channel-like space extending in the longitudinal direction of the material web, which however is not there in the storage position shown, in which the walls of the material web are pressed flat towards each other. An amount of casting moulds may in this way be provided while requiring a minimum of space.

Figure 2:
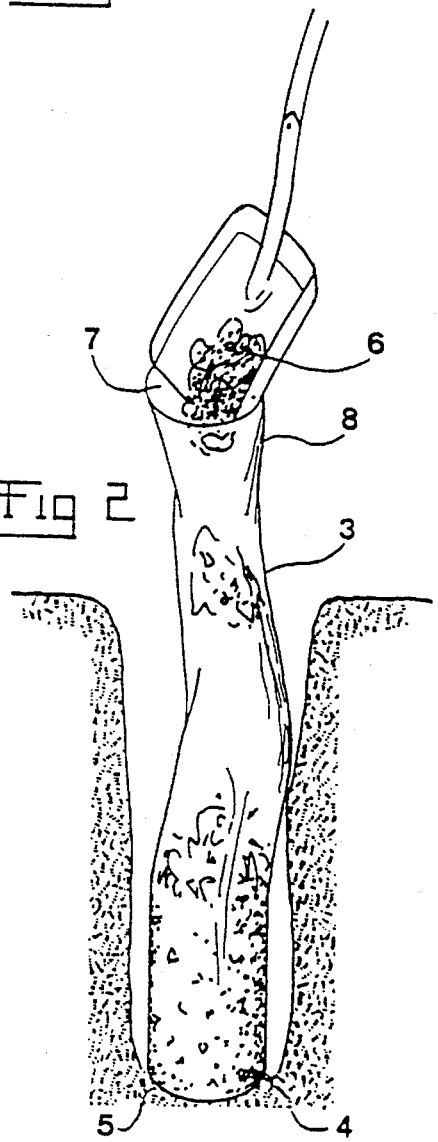
FIG. 2 is a partially sectioned perspective view illustrating the use of a casting mould according to a preferred embodiment of the invention while filling with cast compound.
Figure 3:
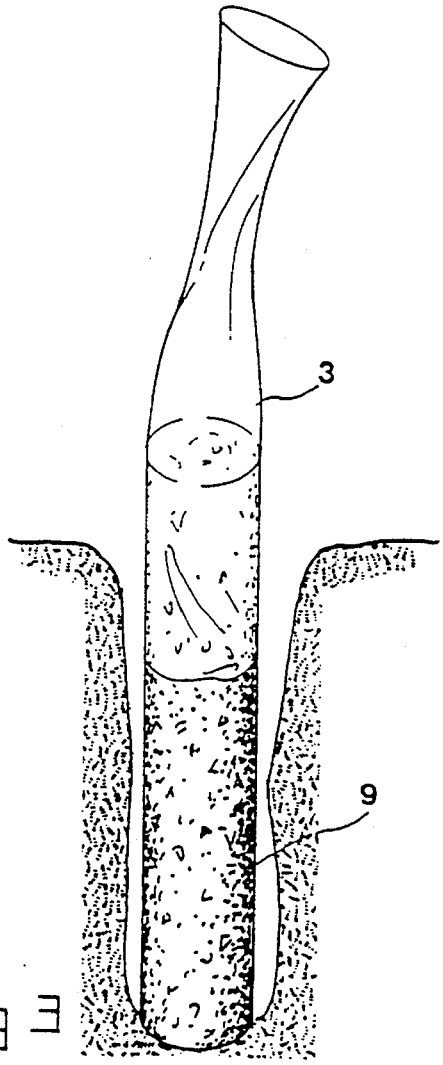
FIG. 3 is a partially sectioned perspective view of a column obtained later on at the casting according to FIG. 2 and it illustrates how the casting mould may be removed when it does not fulfil any function any longer.

A casting mould with a desired length may then at the very casting be separated from the material web 1 by tearing or a simple cut with a knife, by which an envelope open at both ends results. It is shown in FIGS. 2 and 3 how a plinth for for instance a summer cottage is casted from concrete while using such a casting mould separated from the material web. A hole has been dug in the ground, but this is of course not necessary, but it would be well possible to use the casting mould according to the invention in casting columns or the like freely resting for example on a flat rock.

When the casting is to take place, the elongated envelope 3 still unfilled is held hanging with one end 4 thereof on an underlayer 5 onto which the object cast is intended to rest, and the cast compound 6, here the concrete, is filled into the envelope through the opening 7 at the upper end 8 of the envelope. The envelope may be held hanging either by a person manually holding the upper end thereof or by fastening the upper end thereof to a stand or the like. The concrete will through the gravitation move downwardly towards the lower end 4 of the envelope and fill the envelope while stretching the walls thereof into a circular cross-section. However, a hose could also be introduced through the opening 7 for spraying concrete directly downwardly to the lower end 4 of the envelope. After initially filling the lower part of the envelope, maybe about 10–20 cm of the length of the envelope, with cast compound, it is advantageous and it may in some cases be necessary to pull the envelope slightly upwardly while simultaneously shaking it by gripping the upper part of the envelope still untilled, so that the lower filled part of the envelope may be adapted as well as possible to the underlayer and an initial vertical orientation of the envelope part filled may be obtained. When this has taken place the filling of the envelope with the concrete according to above is continued until the envelope is filled with concrete to the desired height of the object cast later completed. Thanks to the fact that the concrete by the gravitation will try to press the envelope outwardly, it will stretch the envelope into a circular cross-section and apply stretching forces radially directed and uniformly distributed along the circumference of the envelope to the walls of the envelope, so that these forces neutralise each other and the concrete will in this way keep the envelope vertically oriented, while the latter keeps the concrete together in exactly this orientation. An envelope being apparently completely flabby and lacking every kind of stiffness may by that, in a very surprising way, be utilised as a casting mould for casting vertically standing elongated objects, without the necessity of any further strut or the like during the very casting so as to keep the casting mould in place. However, this does not exclude the possibility to carry out the casting in connection with bearing of any wall or the like from any side against the casting mould, should this be desired.

The reinforcement may after the filling of the envelope with concrete be pushed down into the concrete when this is desired.

When the concrete has set and hardened, the envelope may be removed easily by pulling it upwardly over the column 9 (see FIG. 3) should the envelope be made of plastic material, which does not stick to the concrete.

However, the envelope may principally be made of any material, such as cloth, fabric and the like, under the condition that the material is substantially inelastic and the envelope may be filled by a cast compound introduced thereinto while forming a circular cross-section. Thus, the invention does also comprise casting moulds having for example a conical extension in a stretched state, since the cross-sections of a cone are circular, although the diameter thereof changes in the vertical direction of the cone. The envelope could then be completely flabby and freely flexible in all directions, such as for for instance plastic film for conventional plastic bags, but it would also be possible that the envelope has any kind of stiffness in any direction as far as it may be stretched into said circular cross-section and enables a circumferential even distribution on the envelope of the radial forces emanating from the gravitation of the cast compound with at the most neglectable influence of forces counteracting shape changes and resulting from the inherent stiffness thereon. An envelope made of so called geotextile of the type used for instance in road construction for laying coarse gravel thereon and so on, has turned out to be especially advantageous in concrete casting, since the friction of the concrete with respect to the envelope increases and the rigidity of the casting mould is by that increased, so that higher objects may be cast than when using a plastic envelope. The envelope of geotextile may on the other hand not be pulled away from the object after the hardening of the concrete. The geotextile has preferably a thickness of about 1 mm and is advantageously provided as a flat material web shown in FIG. 1.

The fields of use for the casting moulds according to the invention and the cast compound for filling thereof may vary a lot. As an example of a further possible field of use when using concrete as cast compound casting of bridge columns may be mentioned, wherein preferably a thicker tarpaulin cloth is used as envelope material, but some problems to get the concrete down into the envelope may arise as a consequence of the high water pressure on the envelope at greater water depth.

It appears from the above that the invention is of course not in any way restricted to the preferred embodiment described above, but several possibilities to modifications thereof would be apparent to a man skilled in the art without departing from the basic idea of the invention as defined in the appended claims.

The definition "objects standing on an underlayer and extending vertically" in the claims means that the object is intended to stand on an underlayer during the casting while extending vertically, but it is not necessary that the object is to remain on the underlayer after the hardening of the cast compound or even that the object is going to be vertically orientated at later use thereof. Thus, casting of column-like objects, for instance fence poles, on an underlayer in an industrial building or the like for a later transport to the place of use or arrangement in any building, machine or the like, is included.

The definition "be stretched" in the claims means that the cast compound brings the envelope to assume a shape having a circular cross-section, but there is not any dilatation, but the length of the circumference of the envelope is predetermined and constant.

I claim:

1. A casting mold for keeping a casting material together when casting elongated objects therefrom standing on an underlayer and extending vertically, said casting mold comprising a flexible and substantially inelastic elongated envelope (3) having an opening (7) at one end (8) thereof for supplying the casting material (6), said substantially inelastic elongated envelope having a thickness sufficient to provide said envelope with enough strength to provide by itself support required for assuming and maintaining vertical extension without any exterior supporting wall, said envelope being arranged to be held substantially vertically while being stretched by the casting material introduced through said opening so as to form a casting mold having a circular cross section, extending vertically and supporting and keeping the casting material together, so that the casting mold can stand freely on the underlayer during casting.

2. A casting mold according to claim 1, wherein the envelope (3) is open at both opposite ends (4, 8) thereof.

3. A casting mold according to claim 2, wherein the envelope (3) is formed by a member separated from an elongated, substantially flat envelope web (1).

4. A casting mold according to claim 3, wherein the envelope (3) is made of plastic material.

5. A casting mold according to claim 4, wherein the envelope (3) is made of a thin plastic film.

6. A casting mold according to claim 5, wherein the envelope (3) is made of a plastic material having a thickness of tenths of a millimeter.

7. A casting mold according to claim 6, wherein the envelope (3) has a circumference being substantially constant in the longitudinal direction thereof and is arranged to assume the shape of a cylinder in the filled part thereof in the state in which it is filled by cast compound.

8. A casting mold according to claim 6, wherein the envelope (3) has a circumference changing continuously in the longitudinal direction thereof and is arranged to assume the shape of a cone in the filled part thereof in the state in which it is filled by cast compound.

9. A casting mold according to claim 1, wherein the envelope (3) is formed by a member separated from an elongated substantially flat envelope web (1).

10. A casting mold according to claim 1, wherein the envelope (3) is made of plastic material.

11. A casting mold according to claim 10, wherein the envelope (3) is made of a thin plastic film.

12. A casting mold according to claim 11, wherein the envelope (3) is made of a plastic material having a thickness of tenths of a millimeter.

13. A casting mold according to claim 1, wherein the envelope (3) has a circumference being substantially constant in the longitudinal direction thereof and is arranged to assume the shape of a cylinder in the filled part thereof in the state in which it is filled by cast compound.

14. A casting mold according to claim 1, wherein the envelope (3) has a circumference changing continuously in the longitudinal direction thereof and is arranged to assume the shape of a cone in the filled part thereof in the state in which it is filled by cast compound.

15. A casting mold according to claim 2, wherein the envelope (3) is made of plastic material.

16. A method for casting an elongated, vertically extending object, comprising:

hanging a flexible and substantially inelastic elongated envelope with a lower end thereof resting on an underlayer, an opposite and upper end of said flexible and substantially inelastic elongated envelope being open;

casting a casting material through said opening at said upper end thereof so as to fill said flexible and substantially inelastic envelope from said lower end thereof while gradually stretching said envelope from below and upwardly with internal pressure provided by said casting material to form a substantially circular cross-section and without exterior support of said circular cross-section, wherein said envelope by itself is capable of supporting and keeping said casting material together so that said envelope with a portion of said casting material therein can stand freely on an underlayer during said casting; and permitting said casting material in said envelope to harden.

17. A method according to claim 16, wherein after initially filling a lower part of the envelope with casting material (6) a tractive force upwardly as well as shaking is applied to the envelope (3) through the part thereof being still unfilled so that the lower filled part of the envelope is adapted to the underlayer (5) while having the longitudinal direction thereof vertically orientated, whereupon the filling of the envelope with casting material is continued.

18. A method according to claim 16, wherein the envelope (3) is made of plastic material.

19. A method according to claim 18, wherein the envelope (3) is made of a thin plastic film of thickness sufficient to provide said envelope with enough strength to provide by itself the support required for assuming and maintaining said vertical extension without any exterior supporting wall.

20. In a method for casting a vertically elongated object in a mold, comprising providing a vertically elongated mold, casting a casting material within said vertically elongated mold, and hardening said casting material to form said object, the improvement wherein said vertically elongated mold is a flexible and substantially inelastic elongated envelope having an opening at one end thereof for supplying said casting material, said flexible and substantially inelastic envelope constituting means for alone supporting and keeping said casting material together, upon said casting of said casting material in said elongated envelope, while standing on an underlayer.

* * * * *